US007791569B2

(12) United States Patent
Hirai

(10) Patent No.: US 7,791,569 B2
(45) Date of Patent: Sep. 7, 2010

(54) LIGHT EMITTING ELEMENT CIRCUIT AND DRIVE METHOD THEREOF

(75) Inventor: Tadahiko Hirai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 12/127,124

(22) Filed: May 27, 2008

(65) Prior Publication Data

US 2008/0297056 A1 Dec. 4, 2008

(30) Foreign Application Priority Data

May 30, 2007 (JP) ..... 2007-143502

(51) Int. Cl.
*G09G 3/30* (2006.01)

(52) U.S. Cl. ..... 345/76; 315/169.3

(58) Field of Classification Search ..... 315/169.3, 315/169.4, 169.1; 345/76, 77, 82–84, 204
See application file for complete search history.

(56) References Cited

U.S. PATENT DOCUMENTS

| | | | | |
|---|---|---|---|---|
| 6,229,506 | B1 | 5/2001 | Dawson et al. | 345/82 |
| 6,373,454 | B1 | 4/2002 | Knapp et al. | 345/76 |
| 6,501,466 | B1 | 12/2002 | Yamagishi et al. | 345/204 |
| 6,693,385 | B2 * | 2/2004 | Koyama | 315/169.3 |
| 6,859,193 | B1 * | 2/2005 | Yumoto | 315/169.3 |
| 7,042,426 | B2 * | 5/2006 | Shin | 345/76 |
| 7,046,240 | B2 * | 5/2006 | Kimura | 345/212 |
| 7,105,855 | B2 * | 9/2006 | Winters | 257/40 |
| 7,106,281 | B2 * | 9/2006 | Kim et al. | 345/76 |
| 7,230,595 | B2 * | 6/2007 | Lih et al. | 345/82 |
| 7,283,109 | B2 * | 10/2007 | Koyama | 345/76 |
| 2007/0182671 | A1 * | 8/2007 | Nathan et al. | 345/76 |
| 2009/0231241 | A1 * | 9/2009 | Abe | 345/76 |

FOREIGN PATENT DOCUMENTS

WO WO 2005/029455 3/2005

* cited by examiner

*Primary Examiner*—Douglas W Owens
*Assistant Examiner*—Ephrem Alemu
(74) *Attorney, Agent, or Firm*—Fitzpatrick, Cella, Harper & Scinto

(57) ABSTRACT

A light emitting element circuit includes a current minor circuit having two thin film transistors, two current input terminals, and two output terminals, a capacitor for holding voltage in accordance with an electric current to be input from one of the two current input terminals, and a light emitting element connected to the current minor circuit. An electric current is supplied to the light emitting element through the current mirror circuit in accordance with the voltage held in the capacitor. The two output terminals of the current mirror circuit are connected to the light emitting element, and the two current input terminals of the current minor circuit are connected with each other through a switch in a time period other than a time period during which an electric current is input from the one of the two current input terminals. In addition, a switching circuit connects the current minor circuit to a matrix wiring, and the current minor circuit includes a switch to connect one of the two output terminals of the current minor circuit to a ground.

10 Claims, 9 Drawing Sheets

LIGHT EMITTING ELEMENT CIRCUIT AND DRIVE METHOD THEREOF

BACKGROUND OF THE INVENTION

1. Field of the Invention

The present invention relates to a pixel circuit of a light emitting element, particularly of an organic electro-luminescence (EL) element to be used in an organic EL display panel, and a drive method thereof, and more particularly relates to a light emitting element circuit which supplies an electric current to the organic EL element through a current mirror circuit and a drive method thereof.

2. Description of the Related Art

In recent years, an electron element with the use of an organic semiconductive material has widely been developed, and it is reported that an organic EL (Electro-Luminescence) element of a light emitting element, an organic TFT (Thin Film Transistor) and an organic solar cell have been developed. Among them, the organic EL display is considered to be promising as a technique which is likely to be practically used in the nearest future.

A structure of the organic EL display panel is classified into a passive-matrix type and an active-matrix type. The passive-matrix type is based on an impulse operation, so that an organic EL element using the passive-matrix type hardly provides a display panel with high brightness because the organic EL element has a trade-off relation between brightness and the life. On the other hand, the active-matrix type does not necessarily need the impulse operation but can make the organic EL element almost uninterruptedly stay on, and accordingly is effective for extending the life of the organic EL element. However, the active-matrix type has a big problem that the characteristics of a transistor (thin film transistor) and the organic EL element composing a pixel circuit and a peripheral circuit are non-uniform and fluctuate with time.

A voltage programming method proposed in U.S. Pat. No. 6,229,506 is a method of compensating a variation of a threshold and drift of the thin film transistor by using an auto zero control.

A current programming method proposed in U.S. Pat. No. 6,373,454 is also a method of compensating the variation of the threshold and mobility of the thin film transistor.

U.S. Pat. No. 6,501,466 proposes a pixel circuit with the use of a current mirror circuit. The current mirror circuit can separate a circuit for supplying an electric current to the organic EL element from a selection circuit, accordingly can decrease the power consumption while performing a current program, and is particularly effective when a thin film transistor having a weak driving force (small mobility) is used.

Leaflet of WO 2005-029455 proposes a pixel circuit with the use of another current mirror circuit. The pixel circuit can compensate the characteristic drift of a thin film transistor and an organic EL element by flowing an electric current to the organic EL element even during programming. The pixel circuit can effectively compensate the characteristic drift even when the thin film transistor has incomplete saturation characteristics and cannot function as a constant current source.

The current mirror circuit has many advantages, but has a defect that the same current cannot be held when the characteristics of two thin film transistors composing a current mirror are deviated from each other. When the temporal cumulative amounts of electric currents flowing through the two thin film transistors are different, the characteristic drifts become different, and as a result, the characteristics of the thin film transistors are greatly deviated from each other after having been operated for many hours.

FIG. 14 is a current mirror type of a pixel circuit which is proposed in the above described leaflet of WO 2005-029455. In the current mirror type of the pixel circuit, one thin film transistor of the two thin film transistors composing the current mirror flows an electric current for current programming and the other thin film transistor drives an organic EL element. Accordingly, a current and voltage stress (which is a force that causes a characteristic change and is used hereafter in the present specification) applied to the two thin film transistors composing the current mirror is greatly different, which causes a problem that the above described difference of the characteristics between the thin film transistors is formed.

Thus, it is desired for the organic EL element having the current mirror type of the pixel circuit to suppress the deviation of the characteristics between the two thin film transistors composing the current mirror.

SUMMARY OF THE INVENTION

It is an aspect of the invention to provide a light emitting element circuit which suppresses the difference of the characteristics between two thin film transistors composing a current mirror, with a simple structure while maintaining an advantage of a current mirror circuit, and a drive method thereof.

In order to achieve the above described aspect, a light emitting element circuit according to the present invention includes a current mirror circuit which includes two thin film transistors, two current input terminals and two output terminals, a capacitor for holding voltage corresponding to an electric current to be input from one of the two current input terminals, and a light emitting element connected to the current mirror circuit, and supplies an electric current in accordance with the voltage held in the capacitor to the light emitting element through the current mirror circuit, wherein the two output terminals of the current mirror circuit are connected to the light emitting element, and the two current input terminals of the current mirror circuit are connected with each other through a switch in a time period other than a time period during which an electric current is input from the one of the two current input terminals.

The light emitting element circuit according to the present invention may further include a switching circuit which connects the current mirror circuit to a matrix wiring, and a holding capacitor which is connected to the current mirror circuit.

A method of the present invention for driving a light emitting element circuit which includes a current mirror circuit that includes two thin film transistors, two current input terminals and two output terminals, a capacitor connected to the current mirror circuit, and a light emitting element connected to the current mirror circuit, the light emitting element circuit being arranged to supply an electric current to the light emitting element through the current mirror circuit, the two output terminals of the current mirror circuit being connected to the light emitting element, and the two current input terminals of the current mirror circuit being connected through a switch, comprises the steps of turning the switch off and flowing an electric current to the light emitting element to make the capacitor hold voltage corresponding to the electric current, and turning the switch on and flowing an electric current corresponding to the held voltage from the two output terminals of the current mirror circuit to the light emitting element.

In the present invention, the light emitting element circuit further may include a switching circuit connected in between matrix electric wiring and the current mirror circuit, and a ground switch which connects the output terminal of the current mirror circuit with a ground potential, and the drive method may have a time period during which the ground switch turns on and the output terminal of the current mirror circuit becomes the ground potential.

The present invention can provide a light emitting element circuit which suppresses the difference of the characteristics between two thin film transistors composing the current mirror, with a simple structure while maintaining an advantage of the current mirror circuit, and a drive method thereof.

Further features of the present invention will become apparent from the following description of exemplary embodiments with reference to the attached drawings.

DETAILED DESCRIPTION INCLUDING BEST MODE

Exemplary embodiments of a light emitting element circuit and a drive method thereof according to the present invention will be described with reference to the drawings.

The term "current mirror circuit" used in the present specification means a circuit which has two current paths and transistors installed in current paths respectively so that the respective voltages between the gate and the source are set to be capable of being equal. The voltages between the gate and the source of two transistors are equal, so that an equal current flows in the two paths if the transistors would have the same characteristics.

First Embodiment

First of all, a basic structure of a light emitting element circuit to be used in an organic EL display panel and a drive method thereof in a first embodiment according to the present invention will be described with reference to FIGS. 1 to 3.

Figure 1:
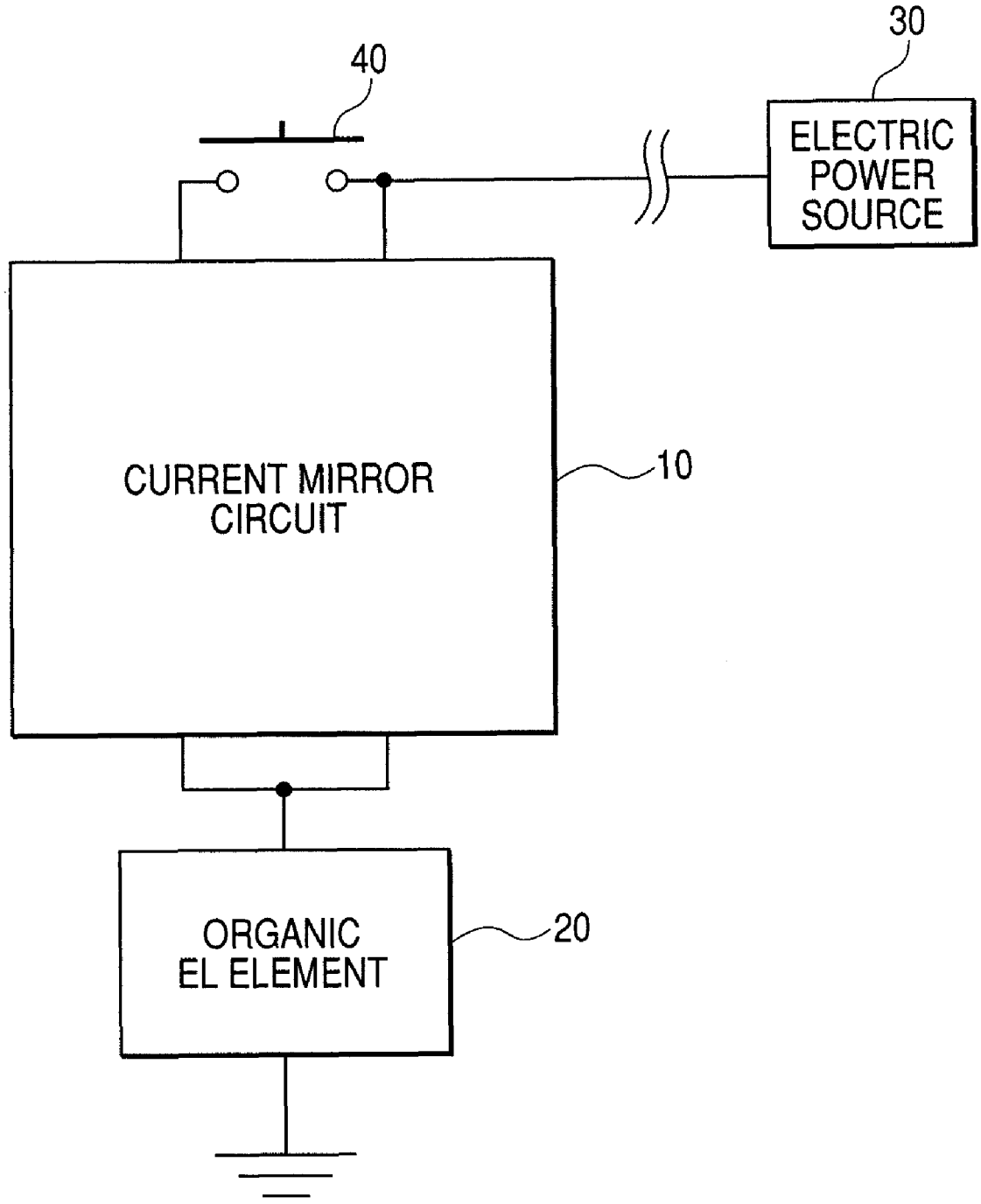
FIG. 1 is a view illustrating a basic structure of a light emitting element circuit according to a first embodiment of the present invention.

A circuit containing an organic EL element illustrated in FIG. 1 includes a current mirror circuit 10 and an organic EL element 20. The current mirror circuit 10 according to the present invention includes two terminals which are connected to an electric power source 30 and receive a supplied electric current (hereinafter referred to as an input terminal) and two terminals which are connected to an organic EL element 20 and supplies an electric current to the organic EL element 20 (hereinafter referred to as an output terminal). The two input terminals are contacted to each other through a switch 40.

Figure 2:
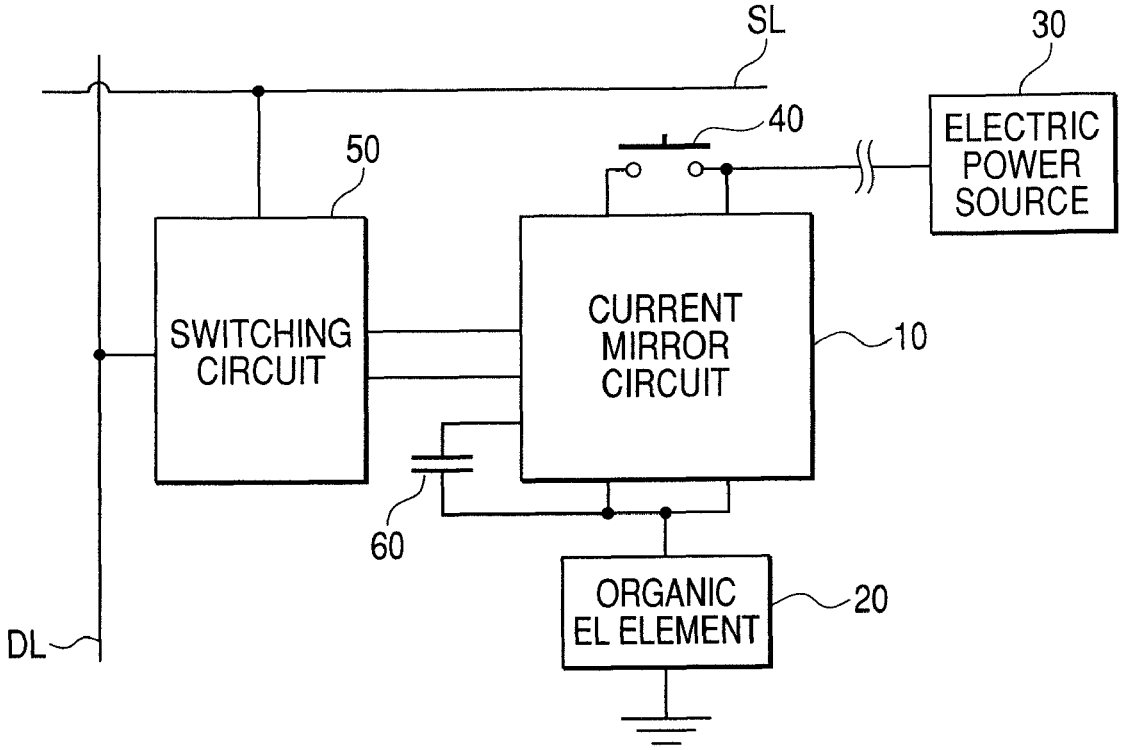
FIG. 2 is a view illustrating a basic structure of a light emitting element circuit according to a first embodiment of the present invention.
Figure 3:
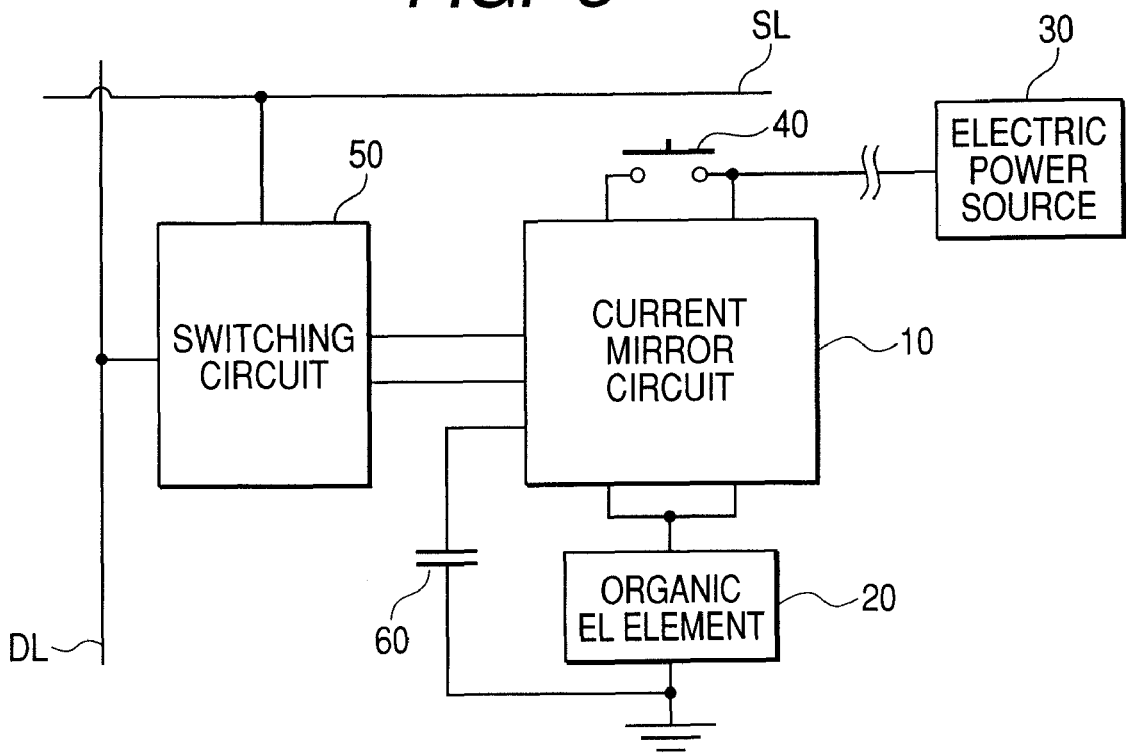
FIG. 3 is a view illustrating a basic structure of a light emitting element circuit according to a first embodiment of the present invention.

The present exemplary embodiment is based on the above described structure, and in addition to this, has matrix electric wiring in which wires intersect with each other, a switching circuit 50 which is connected to both matrix electric wires, and a holding capacitor 60 which is connected to the current mirror circuit 10, as are illustrated in FIGS. 2 and 3.

The matrix electric wiring includes a Data Line DL for supplying a data signal Data, and a Select Line for supplying a control signal Select.

The circuits of FIG. 1 are arranged respectively at intersections of the matrix electric wiring to compose pixels of a matrix display unit. Hereinafter, the light emitting element circuit of FIG. 1 is referred to as an organic EL pixel circuit.

FIGS. 2 and 3 illustrate cases in which connection configurations of the holding capacitor 60 are different from each other. In an example of FIG. 2, one terminal of the holding capacitor 60 is connected to a connecting point of an output terminal of the current mirror circuit 10 and the organic EL element 20. In an example of FIG. 3, one terminal of the holding capacitor 60 is grounded. Other parts of the structure are similar to those in FIG. 2.

When brightness is programmed into the organic EL pixel circuit having the above described structure, the switch 40 is turned off to flow an electric current to the organic EL element 20 so that voltage corresponding to the current is held to the holding capacitor 60. By the operation, an electric current is programmed (fixed) in the current mirror circuit 10. After the electric current has been programmed in the organic EL pixel circuit, the switch 40 is turned on to supply an electric current determined in accordance with the voltage of the holding capacitor is supplied to the organic EL element 20 from the two output terminals of the current mirror circuit 10. By the operation, the organic EL element 20 emits light having brightness corresponding to the supplied electric current thereto.

Because the switch 40 is installed in the organic EL pixel circuit, the same quantity of an electric current constantly flows through two thin film transistors composing the current mirror circuit 10, except a time period during which an electric current for programming flows to one thin film transistor. In an active-matrix type display, the electric current is programmed in every one select line with the use of the matrix electric wiring, so that a time period during which the electric current for programming flows through the thin film transistor is extremely short, and the thin film transistors spend most of the time period to supply an electric current to the organic EL element 20. As a result, even if the characteristics of the thin film transistor drift with time, a gap of the characteristics between the two thin film transistors can be decreased.

Next, an organic EL pixel circuit and a drive method thereof according to the present embodiment will be described with reference to FIGS. 4 and 5.

Figure 4:
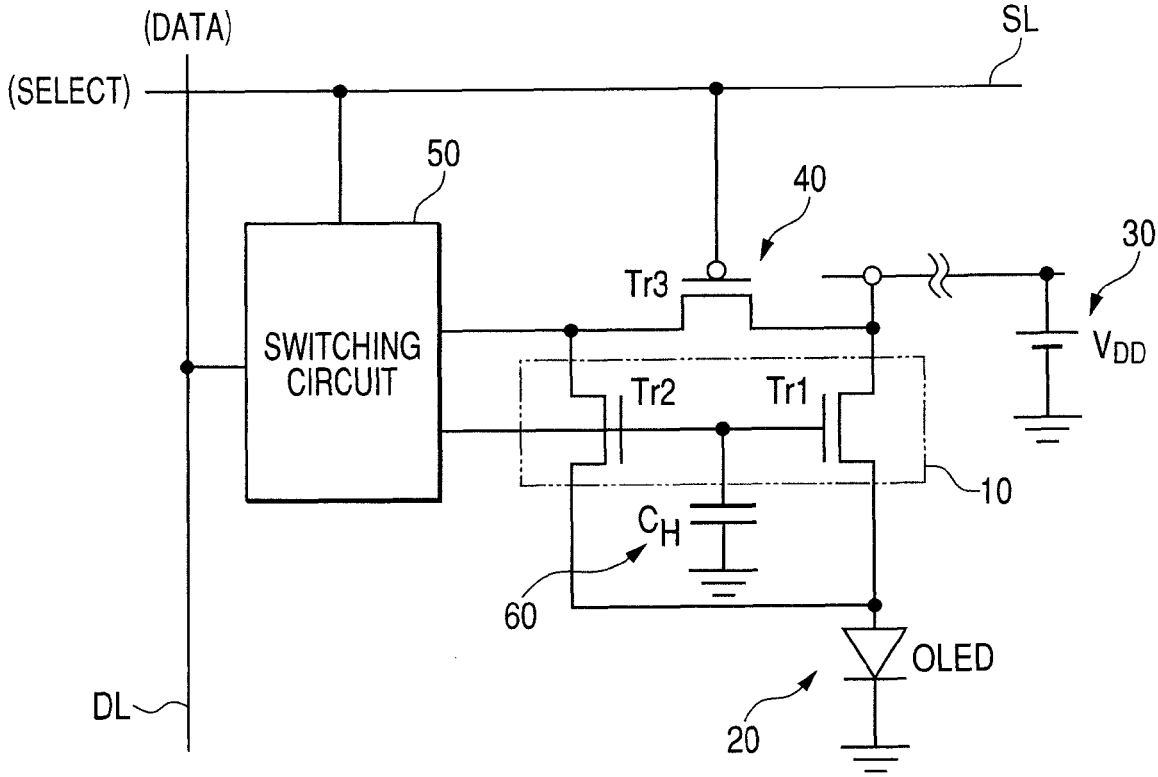
FIG. 4 is a circuit diagram illustrating a structure of a light emitting element circuit according to a first embodiment of the present invention.

An organic EL pixel circuit illustrated in FIG. 4 is a specified structure of a pixel circuit having a structure of FIG. 2. The organic EL pixel circuit has matrix electric wiring specifically in which data lines DL for supplying a data signal Data and select lines SL for supplying a control signal Select are arranged so as intersect with each other. The organic EL pixel circuit has a circuit structure having a current mirror circuit 10, an organic EL element (hereinafter referred to as "OLED: Organic Light Emitting Diode") 20, a switch 40, a switching circuit 50 and a holding capacitor ($C_H$) 60.

The current mirror circuit 10 has two current input terminals for inputting a power source current from an electric power source ($V_{DD}$) 30 and two output terminals which are connected to the same OLED 20. The two current input terminals are connected to each other through the switch 40. The current mirror circuit 10 includes two transistors, that is to say, a first transistor Tr1 and a second transistor Tr2. In the present embodiment, the first transistor Tr1 and the second transistor Tr2 are formed of an n-type thin film transistor.

The gate electrode of the first transistor Tr1 out of the transistors is connected to the gate electrode of the second transistor Tr2 and the switching circuit 50, and a source electrode is connected to an anode of the OLED 20, and a drain electrode is connected to the electric power source $V_{DD}$ and the switch 40. On the other hand, the gate electrode of the second transistor Tr2 is connected to the gate electrode of the first transistor Tr1 and the switching circuit 50, the source electrode is connected to the anode of the OLED 20, and the drain electrode is connected to the switching circuit 50 and the switch 40.

The anode of the OLED 20 is connected to the electric power source $V_{DD}$ through the first transistor Tr1 in the current mirror circuit 10 and a cathode is grounded.

The switch 40 includes a third transistor Tr3 for connecting two input terminals of the current mirror circuit 10 with each other. The third transistor Tr3 in the present embodiment is formed of a p-type thin film transistor. The gate electrode is connected to the select line SL, and a source electrode and a drain electrode are connected to two input terminals of the current mirror circuit 10.

As for the switching circuit 50, an input side is connected to the data line DL and the select line SL, and an output side is connected to one current input terminal of the current mirror circuit 10 and the gate electrodes of the first transistor Tr1 and the second transistor Tr2 in the current mirror circuit 10.

As for the holding capacitor $C_H$, one terminal is connected to each gate electrode of the first transistor Tr1 and the second transistor Tr2 in the current mirror circuit 10, and the other terminal is connected to each source electrode of the first transistor Tr1 and the second transistor Tr2 in the current mirror circuit 10.

Next, a method for driving a light emitting element circuit (method of applying current and voltage) of the present exemplary embodiment will be described with reference to FIG. 5.

Figure 5:
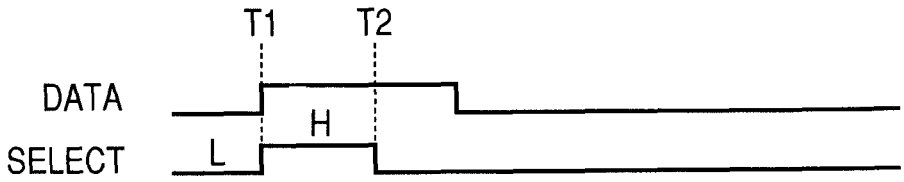
FIG. 5 is a timing chart describing a method for driving a light emitting element circuit according to a first embodiment of the present invention.

FIG. 5 is a timing chart illustrating one cycle of a voltage value or an electric current value, which is applied to each electric wire in an organic EL pixel circuit of FIG. 4. At first, an electric current of a predetermined value for adjusting brightness is supplied to the organic EL pixel circuit according to the data signal Data of the data line DL, at time t1. At the same time, a control signal Select of a select line SL is set at a level H (High), then a switching circuit 50 is operated so that the electric current of the predetermined value flows through to the second transistor Tr2 of the current mirror circuit 10 and an OLED 20, and the third transistor Tr3 is turned off. Thus, a voltage with a necessary value for flowing a predetermined value of an electric current is accumulated in gate electrode of the first transistor Tr1 and the second transistor Tr2 in the current mirror circuit 10 and the holding capacitor $C_H$.

Subsequently, at time t2, the control signal Select of the select line SL is set at a level L (Low), then it is stopped to pass the electric current of the predetermined value to the second transistor Tr2 and the OLED 20, and the third transistor Tr3 is simultaneously turned on. At this time, an on/off control signal of the third transistor Tr3 can be shared with an on/off control signal of the switching circuit 50.

By this operation, an electric current to flow into the OLED 20 through the current mirror circuit 10 is supplied through both of the first transistor Tr1 and the second transistor Tr2. Accordingly, the first transistor Tr1 and the second transistor Tr2 composing the current mirror circuit 10 have an approximately equal history of the electric current, which can decrease a gap of the characteristics between the transistors.

Second Embodiment

In the next place, an organic EL pixel circuit to be used in an organic EL display panel and a drive method thereof in a second embodiment of the present invention will be described with reference to FIGS. 6 and 7. The organic EL pixel circuit of the present embodiment has a different structure from that of the first embodiment, in which two select lines, that is to say, the first select line and the second select line, are arranged instead of the select line SL in the first embodiment. Other parts in the structure are similar to those in the first embodiment.

Figure 6:
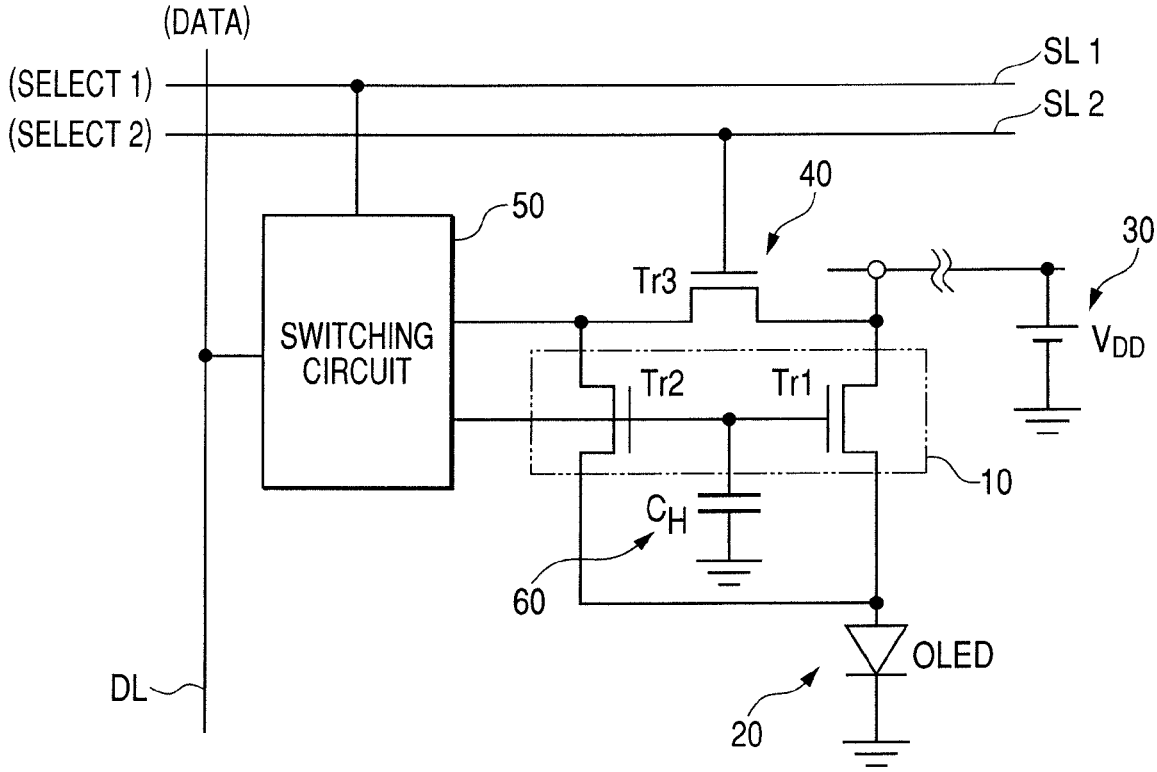
FIG. 6 is a circuit diagram illustrating a structure of a light emitting element circuit according to a second embodiment of the present invention.

An organic EL pixel circuit illustrated in FIG. 6 has matrix electric wiring specifically in which a data line DL for supplying a data signal Data is arranged and a first select line SL1 and a second select line SL2 for respectively supplying a first control signal Select 1 and a second control signal Select 2 are arranged so as to intersect with data line DL. The circuit structure has a current mirror circuit 10, an organic EL element (hereinafter referred to as "OLED") 20, a switch 40, a switching circuit 50 and a holding capacitor ($C_H$) 60.

The current mirror circuit 10 has two current input terminals for inputting a power source current from an electric power source ($V_{DD}$) 30 and two output terminals which are connected to the same OLED 20. The two current input terminals are connected to each other through the switch 40. The current mirror circuit 10 includes two transistors, that is to say, a first transistor Tr1 and a second transistor Tr2. In the present embodiment, the first transistor Tr1 and the second transistor Tr2 are formed of an n-type thin film transistor.

The gate electrode of the first transistor Tr1 out of the transistors is connected to the gate electrode of the second transistor Tr2 and the switching circuit 50, and a source electrode is connected to an anode of the OLED 20, and a drain electrode is connected to the electric power source $V_{DD}$ and the switch 40. On the other hand, the gate electrode of the second transistor Tr2 is connected to the gate electrode of the first transistor Tr1 and the switching circuit 50, the source electrode is connected to the anode of the OLED 20, and the drain electrode is connected to the switching circuit 50 and the switch 40.

The anode of the OLED 20 is connected to the electric power source $V_{DD}$ through the first transistor Tr1 in the current mirror circuit 10 and a cathode is grounded.

The switch 40 includes a third transistor Tr3 for connecting two input terminals of the current mirror circuit 10 with each other. The third transistor Tr3 in the present embodiment is formed of an n-type thin film transistor. The gate electrode is connected to the second select line SL 2, and a source electrode and a drain electrode are connected to two input terminals of the current mirror circuit 10.

As for the switching circuit 50, an input side is connected to the data line DL and the first select line SL1, and an output side is connected to one current input terminal of the current mirror circuit 10 and gate electrodes of the first transistor Tr1 and the second transistor Tr2 in the current mirror circuit 10.

Next, a method for driving a light emitting element circuit (method of applying current and voltage) of the present exemplary embodiment will be described with reference to FIG. 7.

Figure 7:
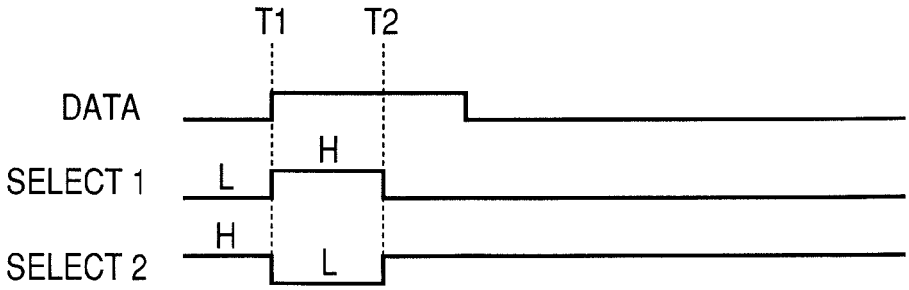
FIG. 7 is a timing chart describing a method for driving a light emitting element circuit according to a second embodiment of the present invention.

FIG. 7 is a timing chart illustrating one cycle of a voltage value or an electric current value, which is applied to each electric wire in an organic EL pixel circuit of FIG. 6. At first, an electric current of a predetermined value for adjusting brightness is supplied as the data signal Data of the data line DL, at time t1. At the same time, a first control signal Select 1 of a select line SL1 is set at a level H, then a switching circuit 50 is operated so that an electric current of a predetermined value flows through to a second transistor Tr2 and an OLED 20. In addition, at the same time, a second control signal Select 2 of a second select line SL2 is set at a level L, and a third transistor Tr3 is turned off. Thus, a voltage with a necessary value for flowing a predetermined value of an electric current is accumulated in gate electrode of the first transistor Tr1 and the second transistor Tr2 and a holding capacitor $C_H$.

Subsequently, at time t2, the first control signal Select 1 of the first select line SL1 is set at a level H, then it is stopped to pass the electric current of the predetermined value to the second transistor Tr2 and the OLED 20. At the same time, the third transistor Tr3 is turned on by the second control signal Select 2 of the second select line SL2.

By this operation, an electric current to be flowed to the OLED 20 through the current mirror circuit 10 is supplied through both of the first transistor Tr1 and the second transistor Tr2. Accordingly, the first transistor Tr1 and the second transistor Tr2 composing the current mirror circuit 10 have an approximately equal characteristic drift, which can decrease a gap of the characteristics between the transistors to the minimum value.

Figure 8:
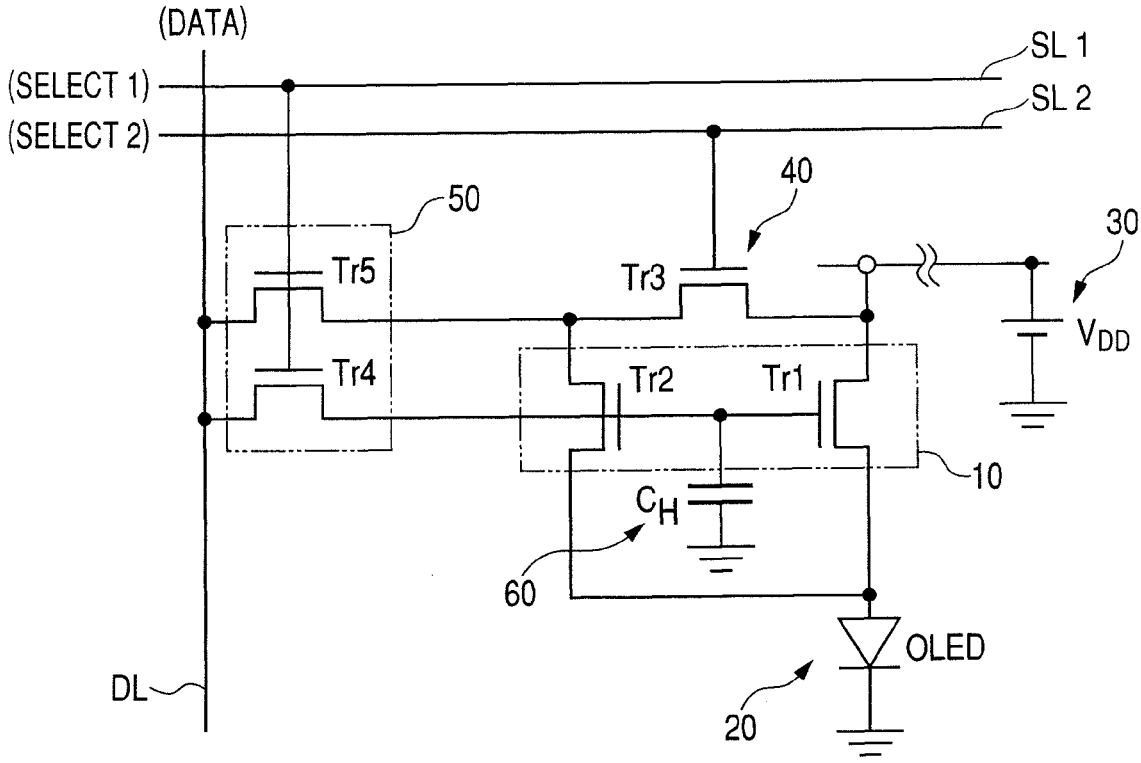
FIG. 8 is a circuit diagram illustrating a structure of a light emitting element circuit according to a second embodiment and an example 1 of the present invention.

In the next place, an organic EL pixel circuit to be used in an organic EL display panel and a drive method thereof in the present embodiment will be described with reference to FIGS. 8 and 9. FIG. 8 illustrates a specified structure of the switching circuit 50 of FIG. 6.

An organic EL pixel circuit illustrated in FIG. 8 has a current mirror circuit 10, an organic EL element (hereinafter referred to as "OLED") 20, a switch 40, a switching circuit 50 and a holding capacitor ($C_H$) 60. The circuit structure except the switching circuit 50 is similar to that of FIG. 6, so that the details will be omitted.

The switching circuit 50 includes two transistors, that is to say, a fourth transistor Tr4 and a fifth transistor Tr5. The fourth transistor Tr4 and the fifth transistor Tr5 are formed of an n-type thin film transistor. The gate electrodes of both transistors are connected to the first select line SL1, and the drain electrodes of both transistors are connected to the data line DL. A source electrode of the fourth transistor Tr4 is connected to gate electrodes of the first transistor Tr1 and the second transistor Tr2 which compose the current mirror circuit 10. A source electrode of the fifth transistor Tr5 is connected to one of input terminals of the current mirror circuit 10.

The anode of the OLED 20 is connected to the electric power source $V_{DD}$ through the first transistor Tr1 in the current mirror circuit 10, and the cathode is grounded. In the present embodiment, for instance, a red element which mainly includes Alq3 (tris(8-hydroxyquinoline) aluminium) is used as the OLED 20.

Next, a method for driving a light emitting element circuit (method of applying current and voltage) of the present embodiment will be described with reference to FIG. 9.

Figure 9:
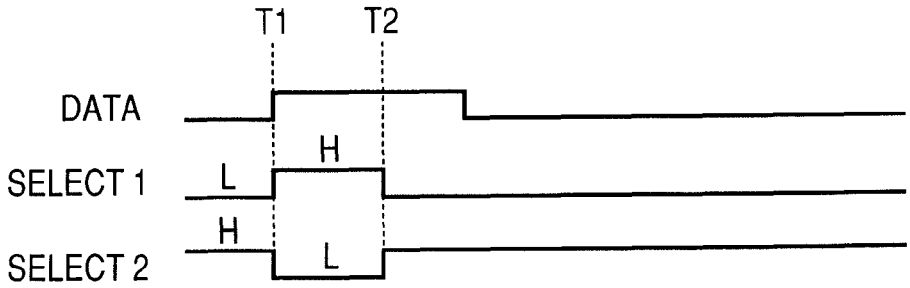
FIG. 9 is a timing chart describing a method for driving a light emitting element circuit according to a second embodiment and an example 1 of the present invention.

FIG. 9 is a timing chart illustrating one cycle of a voltage value or an electric current value, which is applied to each electric wire in an organic EL pixel circuit of FIG. 8.

At first, at time t1, an electric current of a predetermined value for adjusting brightness is supplied to the organic EL pixel circuit according to the data signal Data of the data line DL. At the same time, a first control signal Select 1 of a first select line SL1 is set at a level H, then the fourth transistor Tr4 and the fifth transistor Tr5 of the switching circuit 50 are turned on so that an electric current of a predetermined value flows through to the second transistor Tr2 and an OLED 20. At the same time, a second control signal Select 2 of a second select line SL2 is set at a level L, and a third transistor Tr3 is turned off. Thus, a voltage with a necessary value for flowing an electric current of a predetermined value is accumulated in gate electrode of the first transistor Tr1 and the second transistor Tr2 and a holding capacitor $C_H$.

Subsequently, at time t2, the first control signal Select 1 of the first select line SL1 is set at a level L to turn off the fourth transistor Tr4 and the fifth transistor Tr5, and it is stopped to flow the electric current of the predetermined value to the second transistor Tr2 and the OLED 20. At the same time, the second control signal Select 2 of the second select line SL2 is set at a level H, and the third transistor Tr3 is turned on. Thereby, an electric current is supplied to the OLED 20 through the current mirror circuit 10. By the operation, the OLED 20 turns on to emit a light having brightness corresponding to the supplied electric current thereto.

Then, after the first control signal Select 1 of the first select line SL 1 has been changed into a non-active state (level L), the gate potential of the first transistor Tr1 and the second transistor Tr2 are kept in the state due to carriers accumulated in the holding capacitor $C_H$. For this reason, the OLED 20 continues to emit light in a state that a programmed value of an electric current and voltage is kept.

By this operation, an electric current to be flowed to the OLED 20 through the current mirror circuit 10 is supplied through both of the first transistor Tr1 and the second transistor Tr2. Accordingly, the first transistor Tr1 and the second transistor Tr2 composing the current mirror circuit 10 receive an approximately equal stress, which can decrease a gap of the characteristics between the transistors.

Third Embodiment

In the next place, a third embodiment of the present invention will be described with reference to FIGS. 10 and 11. The organic EL pixel circuit of the present embodiment has a different structure from that of the second embodiment, in which a ground switch 70 for grounding an output side of the current mirror circuit and a select line SL3 for supplying a control signal for controlling the on-off drive are added to the structure of the second embodiment. Other parts of the structure are similar to those in FIG. 8.

Figure 10:
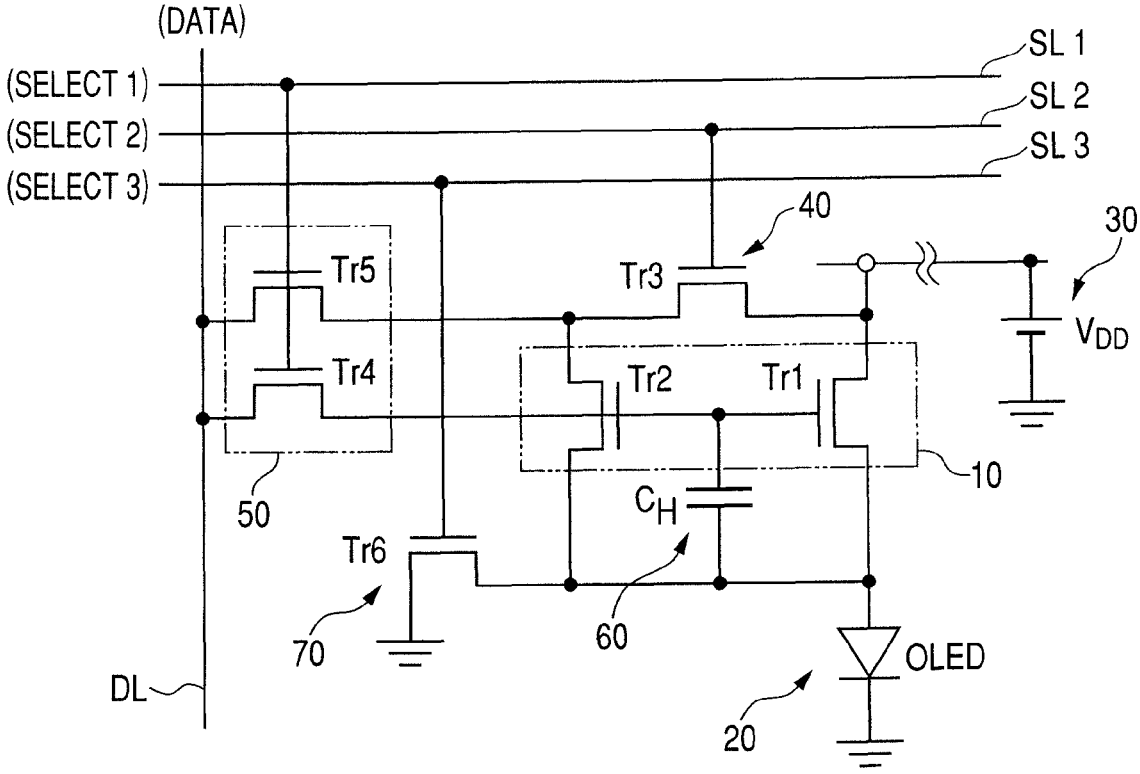
FIG. 10 is a circuit diagram illustrating a structure of a light emitting element circuit according to a third embodiment of the present invention.

An organic EL pixel circuit illustrated in FIG. 10 has a third select line SL3 for supplying a third control signal Select 3, in addition to matrix electric wiring, that is to say, a data line DL, a first select line SL1 and a second select line SL2, which are arranged so as to intersect with the data line DL. The circuit structure has a current mirror circuit 10, an organic EL element (hereinafter referred to as "OLED") 20, a switch 40, a switching circuit 50, a holding capacitor ($C_H$) 60 and a ground switch 70. The circuit structure except the third select line SL3 and the ground switch 70 is similar to that of the second embodiment, so that the details will be omitted.

The ground switch 70 includes a sixth transistor Tr6 for grounding an output side of the current mirror circuit 10. The sixth transistor Tr6 is formed of an n-type thin film transistor. A gate electrode of the n-type thin film transistor is connected to the third select line SL3, and a source electrode and a drain electrode are connected in between two output terminals of the current mirror circuit 10, that is to say, a source electrode side of the first transistor Tr1 and the second transistor Tr2, and the grounded side.

Next, a method for driving a light emitting element circuit (method of applying current and voltage) of the present embodiment will be described with reference to FIG. 11.

Figure 11:
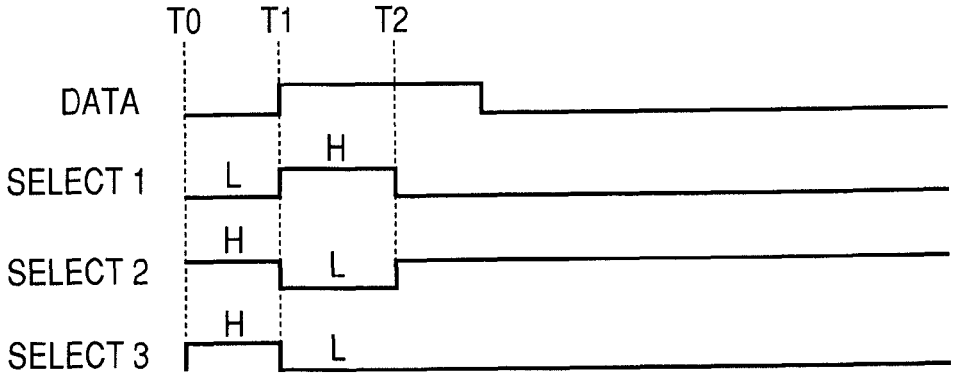
FIG. 11 is a timing chart describing a method for driving a light emitting element circuit according to a third embodiment of the present invention.

FIG. 11 is a timing chart illustrating one cycle of a voltage value or an electric current value, which is applied to each electric wire in the organic EL pixel circuit of FIG. 10. The light emitting element circuit of the present embodiment has a period of time during which the ground switch 70 is turned on and the output terminal of the current mirror circuit 10 becomes a ground potential, compared with the second embodiment.

At first, at time t0, the third control signal Select 3 of the third select line SL3 is set at a level H, and the sixth transistor Tr6 composing the ground switch 70 is turned on so as to ground the output side of the current mirror circuit 10. As a result, the source electrodes of the first transistor Tr1 and the second transistor Tr2 and one of terminals of the holding capacitor $C_H$ are grounded.

Next, at time t1, the third control signal Select 3 of the third select line SL3 is set at a level L, and the sixth transistor Tr6 is turned off. Then, an electric current of a predetermined value for adjusting brightness is supplied to the organic EL pixel circuit according to the data signal Data. At the same time, a first control signal Select 1 of a first select line SL1 is set at a level H, then the fourth transistor Tr4 and the fifth transistor Tr5 of the switching circuit 50 are turned on so that an electric current of a predetermined value flows through to the second transistor Tr2 and the OLED 20. Furthermore, at the same time, a second control signal Select 2 of the second select line SL2 is set at a level L, and a third transistor Tr3 is turned off. Thus, a voltage with a necessary value for flowing a predetermined value of an electric current is accumulated in gate electrode of the first transistor Tr1 and the second transistor Tr2 and the holding capacitor $C_H$.

Subsequently, at time t2, the first control signal Select 1 of the first select line SL1 is set at a level L, then it is stopped to flow the electric current of the predetermined value to the second transistor Tr2 and the OLED 20. At the same time, the second control signal Select 2 of the second select line SL2 is set at a level H, and the third transistor Tr3 is turned on.

By the operation, the gate voltage of the first transistor Tr1 and the second transistor Tr2 are set with respect to the ground potential, so that a stable operation can be expected. By the operation of the third transistor Tr3, an electric current to be flowed to the OLED 20 through the current mirror circuit 10 is supplied through both of the first transistor Tr1 and the second transistor Tr2. Accordingly, the first transistor Tr1 and the second transistor Tr2 composing the current mirror circuit 10 receive an approximately equal stress, which can suppress the characteristic change of the transistors.

As described in the first to third embodiments, a pixel circuit of the present invention has the advantages compared with a prior art, which will be described below.

(1) An electric current to be supplied to the OLED 20 is supplied from an electric power source $V_{DD}$ only through the first transistor Tr1 of the current mirror circuit 10, so that a voltage value of the electric power source $V_{DD}$ can be lowered. Thereby, power consumption can be lowered. This is because when the number of transistors connected in series increases, the voltage needs to be increased.

(2) A value of an electric current to be programmed is determined by flowing the current to the second transistor Tr2 of the current mirror circuit 10 and the OLED 20, and accordingly can be determined after the characteristics drifts of the second transistor Tr2 and the OLED 20 have been corrected. In other words, a consequently-obtained drive method is resistant to the change of characteristics of the first transistor Tr1 of the current mirror circuit 10 and the OLED 20.

(3) Both of the first transistor Tr1 and the second transistor Tr2 in the current mirror circuit 10 work for flowing an electric current supplied from the electric power source $V_{DD}$ to the OLED 20, so that the current flowing through and the voltage applied to the first transistor Tr1 and the second transistor Tr2 can be made approximately equal. Accordingly, the characteristic drifts of the first transistor Tr1 and the second transistor Tr2 composing the current mirror circuit 10 can be made approximately equal, and the gap of the characteristics between the two thin film transistors can be decreased, which has been a problem in a current mirror type of a circuit.

The present invention is not limited to the above described exemplary embodiments and the following examples. The constitution and details according to the present invention can be subjected to various modifications that those skilled in the art can understand, in the scope of the present invention.

The present invention can be applied an organic EL pixel circuit to be used in an organic EL display panel and a drive method thereof.

Example 1

In the next place, examples of a specific circuit structure to which the present invention is applied will be described. The circuit structure in the present example is identical to that of FIGS. 8 and 9 in the second embodiment.

In the circuit of FIG. 8, an anode of an OLED 20 is connected to an electric power source $V_{DD}$ through a first transistor Tr1 in a current mirror circuit 10, and a cathode is grounded.

In the present example, for instance, a red element which mainly includes Alq3 (tris(8-hydroxyquinoline) aluminium) is used as the OLED 20.

A first transistor Tr1 to a fifth transistor Tr5 are formed of an n-type thin film transistor. In the present example, these five n-type of thin film transistors are formed of an n-channel thin film transistor which uses amorphous silicon for an active layer. Any thin film transistor is formed of an n-type amorphous silicon and has a gate length of 5 micrometer. A holding capacitor $C_H$ has a capacitance of 1 pF.

The circuit is operated according to a timing chart of FIG. 9.

Example 2

A structure of a panel with the use of a light emitting element circuit and a drive method thereof according to the present invention will be described with reference to FIGS. 12, 13A and 13B.

Figure 12:
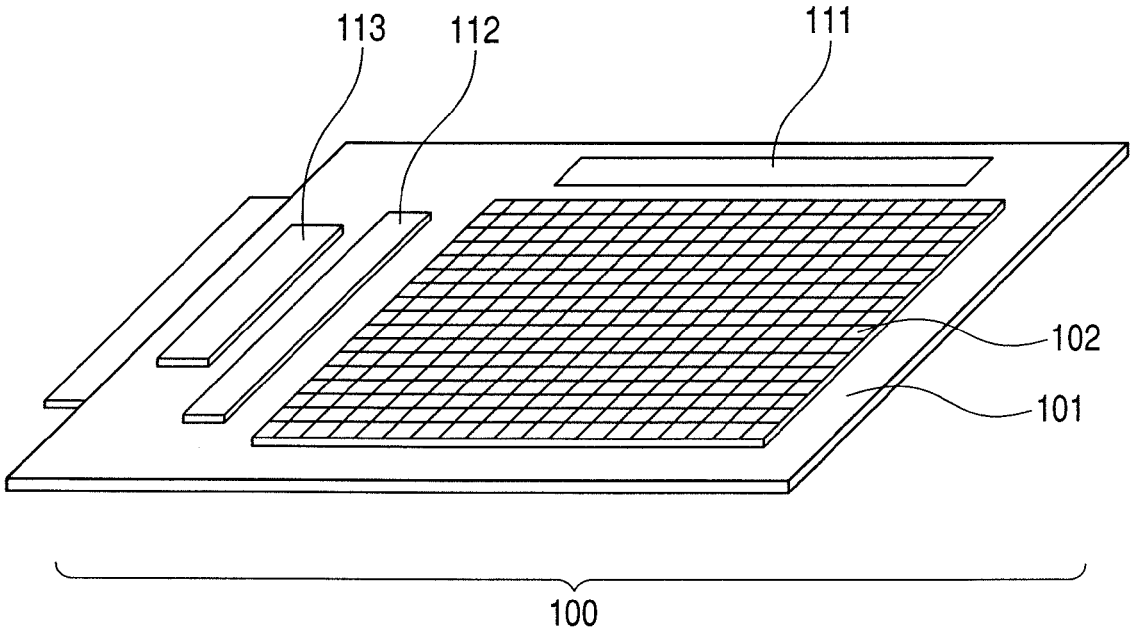
FIG. 12 is a schematic view illustrating a structure of a panel module according to an example of the present invention.

As is illustrated in FIG. 12, a source driver 111, a gate driver 112 and an interface driver 113 for processing an input signal are implemented on a wiring board substrate 101 together with an organic EL panel 102, so as to realize the drive method of the present invention. The above described components compose an organic EL panel module 100. Thereby, the panel can stably display an image based on a digital signal which is input from the outside.

Figure 13A:
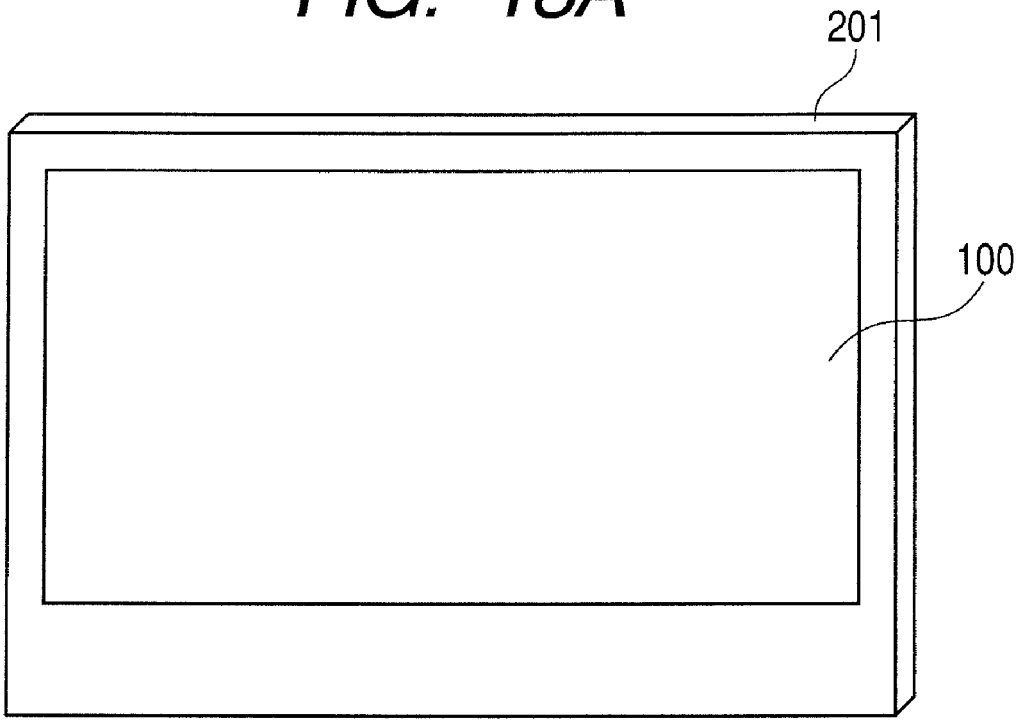
FIGS. 13A and 13B are schematic views illustrating an example of an electronic equipment according to an example of the present invention.
Figure 13B:
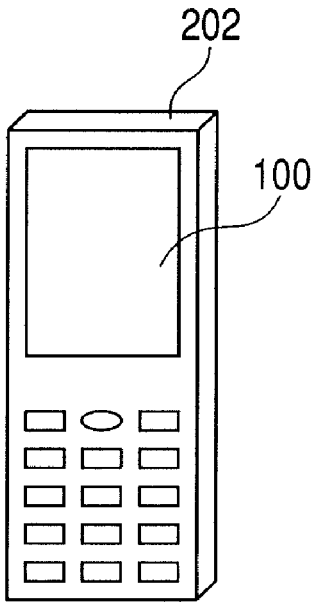
Figure 14:
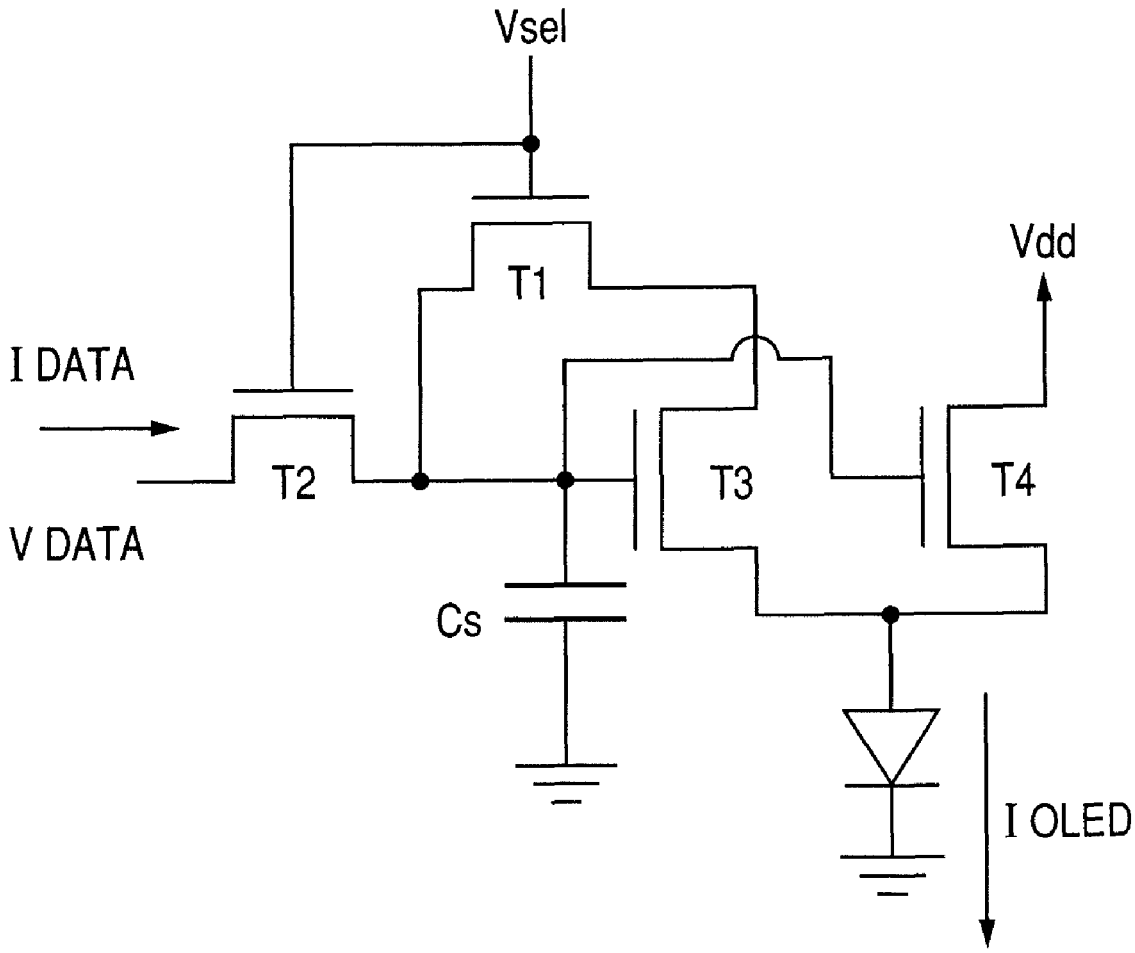
FIG. 14 is a circuit diagram illustrating an example of a drive circuit of a related art.

As is illustrated in FIGS. 13A and 13B, the above described organic EL panel module 100 can compose an electronic equipment such as a television 201 (cf. FIG. 13A) and a portable element 202 (cf. FIG. 13B).

Other Examples

The above described Example 1 describes a case in which the plurality of the thin film transistors are formed while employing amorphous silicon for the active layer, but the present invention is not limited to the amorphous silicon. The active layer of the plurality of the thin film transistors may be formed, for instance, from a material which mainly includes silicon, a material which mainly includes a metal oxide, or a material which mainly includes an organic material.

In the above described first to third embodiments and the Example 1, a current mirror circuit was formed of two n-type thin film transistors, but the present invention is not limited to the n-type thin film transistors. The current mirror circuit may be formed of two p-type thin film transistors, for instance. The important thing is that the current mirror circuit is formed of at least two thin film transistors. Then, any structure can be applied to the current mirror circuit.

In the above described first to third embodiments and the Example 1, a switch was formed of one n-type thin film transistor or one p-type thin film transistor, but the present invention is not limited to the thin film transistors. Any structure can be applied to the switch as long as the switch is formed of at least one thin film transistor.

In the above described second embodiment, the third embodiment and the Example 1, a switching circuit was formed of the two n-type thin film transistors, but the present invention is not limited to the n-type thin film transistors. The switching circuit may be formed of the two p-type thin film transistors, for instance. In other words, any structure can be applied to the switching circuit as long as the switching circuit is formed of at least two thin film transistors.

In the above described first to third embodiments and the Example 1, a holding capacitor ($C_H$) is formed of one capacitor, but the present invention is not limited to the one holding capacitor. Any structure can be applied to the holding capacitor ($C_H$) as long as the holding capacitor ($C_H$) is formed of at least one holding capacitor.

In the first embodiment to third embodiment and the Example 1, the organic EL element (OLED) is formed of one OLED, but the present invention is not limited to one OLED. Any structure can be applied to the organic EL element (OLED) as long as the organic EL element is formed of at least one OLED.

As described above, the current mirror circuit, the OLED, the switch, the switching circuit and the holding capacitor of the present invention may adopt the structures as follows.

(1) a structure including a switching circuit having at least two n-type thin film transistors, a current mirror circuit having at least two n-type thin film transistors, a switch having at least one n-type thin film transistor, at least one holding capacitor, and at least one light emitting element.

(2) a structure including a switching circuit having at least two p-type thin film transistors, a current mirror circuit having at least two p-type thin film transistors, a switch having at least one p-type thin film transistor, at least one holding capacitor, and at least one light emitting element.

(3) a structure including a switching circuit having at least two n-type thin film transistors, a current mirror circuit having at least two n-type thin film transistors, a switch having at least one p-type thin film transistor, at least one holding capacitor, and at least one light emitting element.

(4) a structure including a switching circuit having at least two p-type thin film transistors, a current mirror circuit having at least two p-type thin film transistors, a switch having at least one n-type thin film transistor, at least one holding capacitor, and at least one light emitting element.

While the present invention has been described with reference to exemplary embodiments, it is to be understood that the present invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-143502, filed May 30, 2007, which is hereby incorporated by reference herein in its entirety.

What is claimed is:

1. A light emitting element circuit comprising:

a current mirror circuit which includes two thin film transistors, two current input terminals, and two output terminals;

a capacitor for holding voltage in accordance with an electric current to be input from one of the two current input terminals;

a light emitting element connected to the current mirror circuit, wherein an electric current is supplied to the light emitting element through the current mirror circuit in accordance with the voltage held in the capacitor, and wherein the two output terminals of the current mirror circuit are connected to the light emitting element, and the two current input terminals of the current mirror circuit are connected with each other through a switch in a time period other than a time period during which an electric current is input from the one of the two current input terminals, and a switching circuit to connect the current mirror circuit to a matrix wiring, wherein the current mirror circuit includes a ground switch to connect the two output terminals of the current mirror circuit to a ground.

2. The light emitting element circuit according to claim 1, wherein the switching circuit, the current mirror circuit and the switch each include an n-type thin film transistor.

3. The light emitting element circuit according to claim 1, wherein the switching circuit, the current mirror circuit and the switch each include a p-type thin film transistor.

4. The light emitting element circuit according to claim 1, wherein the switching circuit and the current mirror circuit each include an n-type thin film transistor, and wherein the switch includes a p-type thin film transistor.

5. The light emitting element circuit according to claim 1, wherein the switching circuit and the current mirror circuit each include a p-type thin film transistor, and wherein the switch includes an n-type thin film transistor.

6. The light emitting element circuit according to claim 1, wherein the thin film transistor includes a material containing silicon.

7. The light emitting element circuit according to claim 1, wherein the thin film transistor is an n-type thin film transistor including a material containing a metal oxide.

8. The light emitting element circuit according to claim 1, wherein the thin film transistor includes a material containing an organic material.

9. A display panel comprising a light emitting element circuit according to claim 1.

10. A method for driving the light emitting element circuit that comprises a current mirror circuit including two transistors composing a current mirror, two current input terminals, and two output terminals; a capacitor connected to the current mirror circuit; and a light emitting element connected to the current mirror circuit and including a switching circuit to connect the current mirror circuit to a matrix wiring, and a ground switch which connects an output terminal of the current mirror circuit with a ground, the light emitting element circuit being arranged to supply an electric current to the light emitting element through the current mirror circuit, the two output terminals of the current mirror circuit being connected to the light emitting element, and the two current input terminals of the current mirror circuit being connected through a switch, wherein the method comprises the steps of:

turning the switching circuit on and turning the switch off, thereby flowing electric current to the light emitting element to make the capacitor hold voltage corresponding to the electric current;

turning the switching circuit off and turning the switch on, thereby flowing electric current corresponding to the held voltage from the two output terminals of the current mirror circuit to the light emitting element; and turning the ground switch on to make a potential of the two output terminals of the current minor circuit be the ground.

* * * * *